United States Patent [19]

Mongoven et al.

[11] 4,449,073

[45] May 15, 1984

[54] RUNWAY APPROACH LIGHTING SYSTEM WITH FAULT MONITOR

[75] Inventors: Michael A. Mongoven, Oak Park; Paul R. Bees, Elmhurst; David C. Earl, Naperville, all of Ill.

[73] Assignee: Multi Electric Mfg. Inc., Chicago, Ill.

[21] Appl. No.: 388,120

[22] Filed: Jun. 14, 1982

[51] Int. Cl.[3] ..... H05B 37/03

[52] U.S. Cl. ..... 315/130; 315/200 A; 315/210; 315/323; 340/331; 340/642

[58] Field of Search ..... 315/130, 131, 134–136, 315/200 A, 201, 210, 211, 226, 323; 340/25, 331, 642

[56] References Cited

U.S. PATENT DOCUMENTS

| | | | |
|---|---|---|---|
| 3,710,157 | 1/1973 | Wright | 340/331 X |
| 3,715,741 | 2/1973 | McWade et al. | 340/642 |
| 3,795,905 | 3/1974 | Wright | 315/131 |
| 3,828,334 | 8/1974 | Wallace | 315/132 X |
| 3,829,735 | 8/1974 | Berlock et al. | 315/131 |
| 4,095,140 | 6/1978 | Kirkhuff et al. | 315/199 |
| 4,216,413 | 8/1980 | Plas | 315/323 |
| 4,297,632 | 10/1981 | Glaser et al. | 324/51 |

OTHER PUBLICATIONS

"Lighting System, Airport Approach, Condenser Discharge", Sylvania Electric Products, Inc., Instruction Book.

*Primary Examiner*—Eugene R. LaRoche

*Attorney, Agent, or Firm*—Wood, Dalton, Phillips, Mason & Rowe

[57] ABSTRACT

A runway approach lighting system with fault monitor includes an oscillator which develops clock pulses which are accumulated by a counter. The output of the counter is used to develop trigger signals which control the sequential energization of runway alignment indicator lights. The operation of each light is sensed and is compared with the oscillator pulses, and a fault signal is generated each time a light fails to operate in response to a trigger signal. The number of fault signals generated in an energization cycle is accumulated, and a fault indication is generated once a predetermined number of faults has occurred.

21 Claims, 5 Drawing Figures

RUNWAY APPROACH LIGHTING SYSTEM WITH FAULT MONITOR

BACKGROUND OF THE INVENTION

This invention relates generally to a system for individually energizing each of a plurality of output devices including fault detection apparatus, and more particularly to an approach lighting system for an airport runway having means for detecting the number of faults of runway alignment indicator lights.

A prior system for actuating sequenced flashing lights in an approach lighting system utilizes a motor in conjunction with cam-actuated microswitches for sending control signals to the approach runway lights. A different type of system utilizes a stepping motor for sequentially sending control signals to the lights.

Often, a malfunction may occur in one or more of the lights, thereby reducing the effectiveness of the lighting system.

Previous attempts at detecting the number of faults of lights used in a runway approach lighting system include apparatus for sensing the transmission of a trigger signal for operating each light. However, even when a trigger signal is transmitted to a light, the light may fail to operate, a malfunction which may not be sensed by analyzing the outgoing trigger signal.

Other types of monitoring systems require the intensity of the flashing lights to be increased greatly, thereby necessitating the use of a separate test routine which, in turn, results in undesirable downtime of the system.

SUMMARY OF THE INVENTION

In accordance with the present invention, a runway approach lighting system includes solid state circuitry for sequentially energizing runway approach lights, in conjunction with a continuously operative fault detection system.

Each of a plurality of runway alignment indicator lights are sequentially energized during an energization cycle by means of an oscillator which provides clock pulses to a counter, which in turn accumulates the pulses therefrom. The counter output is decoded by BCD/decimal decoders, in turn coupled to drivers for sending trigger signals to the lights used in the lighting system.

The system is capable of sequentially energizing up to eight runway approach lights, and with the addition of a slave unit, it is capable of energizing 15 or 21 runway approach lights in sequence.

The fault detection system utilizes a comparator, which receives signals from the oscillator and a monitoring system which generates monitoring signals in response to the actual operation of each lamp. If the monitoring signal does not indicate that a light has been actuated within a certain time period after receipt of an oscillator pulse, a fault counter is incremented by one. After a predetermined number of faults has occurred during an energization cycle, a fault indicator is energized to provide a visual or audible alarm.

The lighting system utilizes reliable solid state circuitry, eliminating the need for costly motors and switches which may prove unreliable. Furthermore, since the actual operation of each light is sensed by the fault detection system, a reliable indication of the number of faults is obtained. The fault detecting system is continuously operative, and hence undesirable downtime of the system is avoided.

DESCRIPTION OF THE PREFERRED EMBODIMENT

Figure 1:
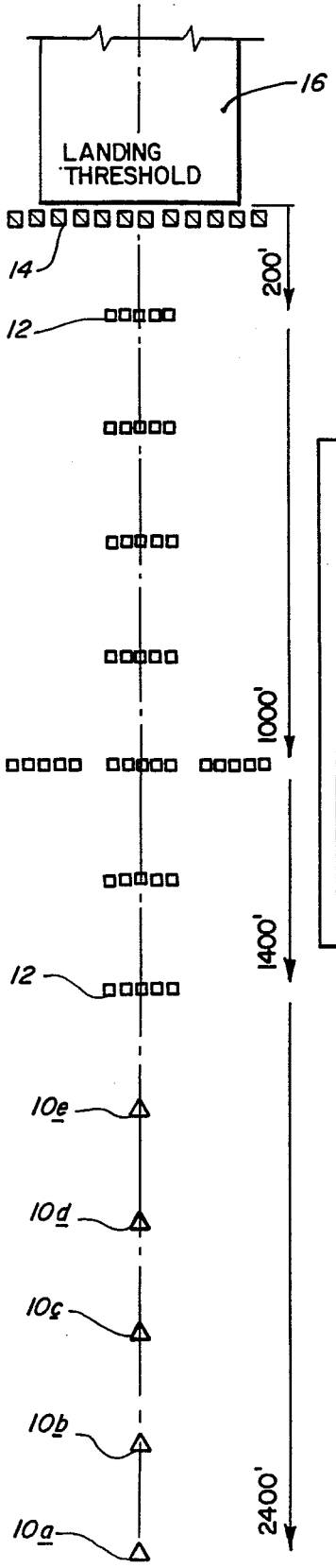
FIG. 1 is a schematic diagram of one type of runway approach lighting configuration.

Referring now to FIG. 1, there is illustrated one type of runway approach lighting configuration for an airport runway with which the present invention may be employed.

The approach lighting configuration shown in FIG. 1 is referred to as MALSR, which is a medium intensity approach lighting system with runway alignment indicator lights. The approach lighting configuration comprises a series of five in-line strobe lights, 10*a*, 10*b*, 10*c*, 10*d* and 10*e*, typically xenon flash tube units, in conjunction with seven rows of steadily burning lights 12 and a single row of landing threshold lights 14. The five strobe lights 10*a* through 10*e* are actuated in an energization cycle to flash in sequence toward the threshold of a runway 16 so that a "rolling ball of fire" effect is presented to an incoming pilot of an aircraft.

The MALSR System typically extends 2400 feet from the landing threshold of the runway 16. A variation of this standard system includes eight sequenced strobe lights 10*a*–10*h* (10*f*–10*h* not shown in FIG. 1) extending 3000 feet from the landing threshold, with the balance of the lighting system being identical to the MALSR lighting system described above.

The present invention will be initially described with particular reference to this system of either five or eight sequenced flashing lights, however, it should be understood that other types of runway approach-type lighting systems exist which utilize up to 21 sequenced flashing lights, and the present invention is equally adaptable to these systems as will be noted below.

Figure 2:
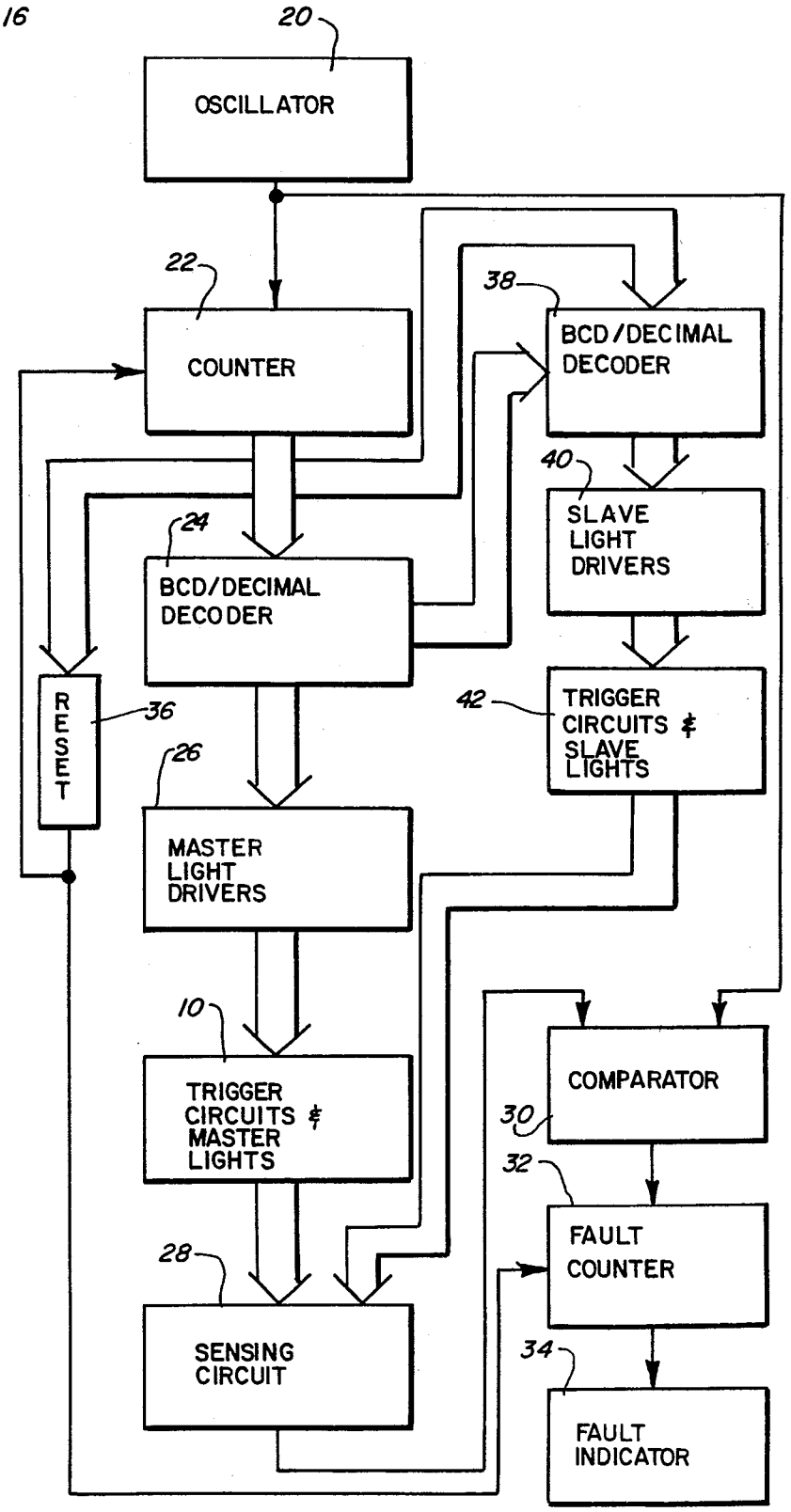
FIG. 2 is a block diagram of the runway approach lighting system of the present invention having means for detecting faults of lights used in the system.

Referring to FIG. 2, there is illustrated in block diagram form a system for energizing the lights 10 which includes apparatus for detecting and generating a fault indication when a predetermined number of lights fail to operate.

The system shown in FIG. 2 is particularly useful for controlling and detecting faults in a runway lighting system; however, the system may also be used to sequentially energize a plurality of output devices where one or more of the devices are subject to malfunction and where it is desirable to generate an indication when a particular number of the output devices have failed.

An oscillator 20 develops clock pulses which are counted by a binary pulse counter 22. The output of the counter 22 is coupled to a BCD/decimal decoder 24 which converts the binary information from the counter 22 into decimal form.

The BCD/decimal decoder 24 in turn provides up to eight outputs to a like number of master light drivers, indicated generally at 26, which in turn provide trigger signals to trigger circuitry for sequentially energizing the lights 10.

The actual operation of each output device is sensed by a sensing circuit 28 which generates monitoring signals in response thereto. The light pulse outputs from the master lights 10 are sequentially sensed by the sensing circuit 28 since normally only one light 10*a* through 10*h* is energized at any particular time in an energization cycle.

The monitoring signals from the circuit 28 are coupled to one input of a comparator 30, which receives as another input the signal from the oscillator 20. The comparator 30 acts to compare the presence of a clock pulse from the oscillator 20 with the monitoring signal and generate a status signal representative of the operative status of each light 10. If the monitoring signal does not indicate that a light 10 has operated within a certain time after receipt of the clock pulse, then a fault pulse is generated by the comparator 30. This pulse is sent to a fault counter 32 which keeps a running total of the number of lights 10 which have failed to light in response to the signals from the master light driver circuit 26.

The fault counter 32 may be programmed to provide an output signal to actuate a fault indicator 34 when the comparator has generated a preselected number of fault pulses within a single energization cycle. Typically, the fault counter 32 actuates the fault indicator 34 when either two or three of the lights have failed, although a different number may be programmed, if desired.

The fault counter 32 and the pulse counter 22 are reset to zero at the end of each cycle, which is typically ½ second in duration per F.A.A. regulations. The counters 22 and 32 receive a reset signal from a reset circuit 36, which senses the output of the counter 22 and generates the reset signal in response thereto.

The circuitry described above is capable of firing up to eight lights in sequence and monitoring the occurrences of faults in this number of lights. If it is desired to operate a greater number of lights, such as 15 or 21 lights, it is necessary to utilize slave circuitry to accommodate the extra flashing lights.

A BCD/decimal decoder 38 receives as inputs the output from the pulse counter 22 and the output from the BCD/decimal decoder 24. The BCD/decimal decoder 38, in turn, is coupled to a slave light driver circuit 40 which is used to sequentially trigger a series of slave lights 42 following the sequential actuation of the master lights 10.

The output from each slave light is sensed by the sensing circuit 28 described above.

The output from the sensing circuit 28 is coupled to the comparator 30, where the comparison is made with the oscillator signal. As noted above, if a clock pulse from the oscillator 20 is received by the comparator 30, but a signal is not received within a particular time period thereafter indicating that a light 42 has operated, then the fault counter 32 is incremented by one, advancing it toward the threshold at which the fault indicator 34 is energized.

The fault indicator 34 may be an audible or visual alarm or may be a combination of the two.

Figure 3A:
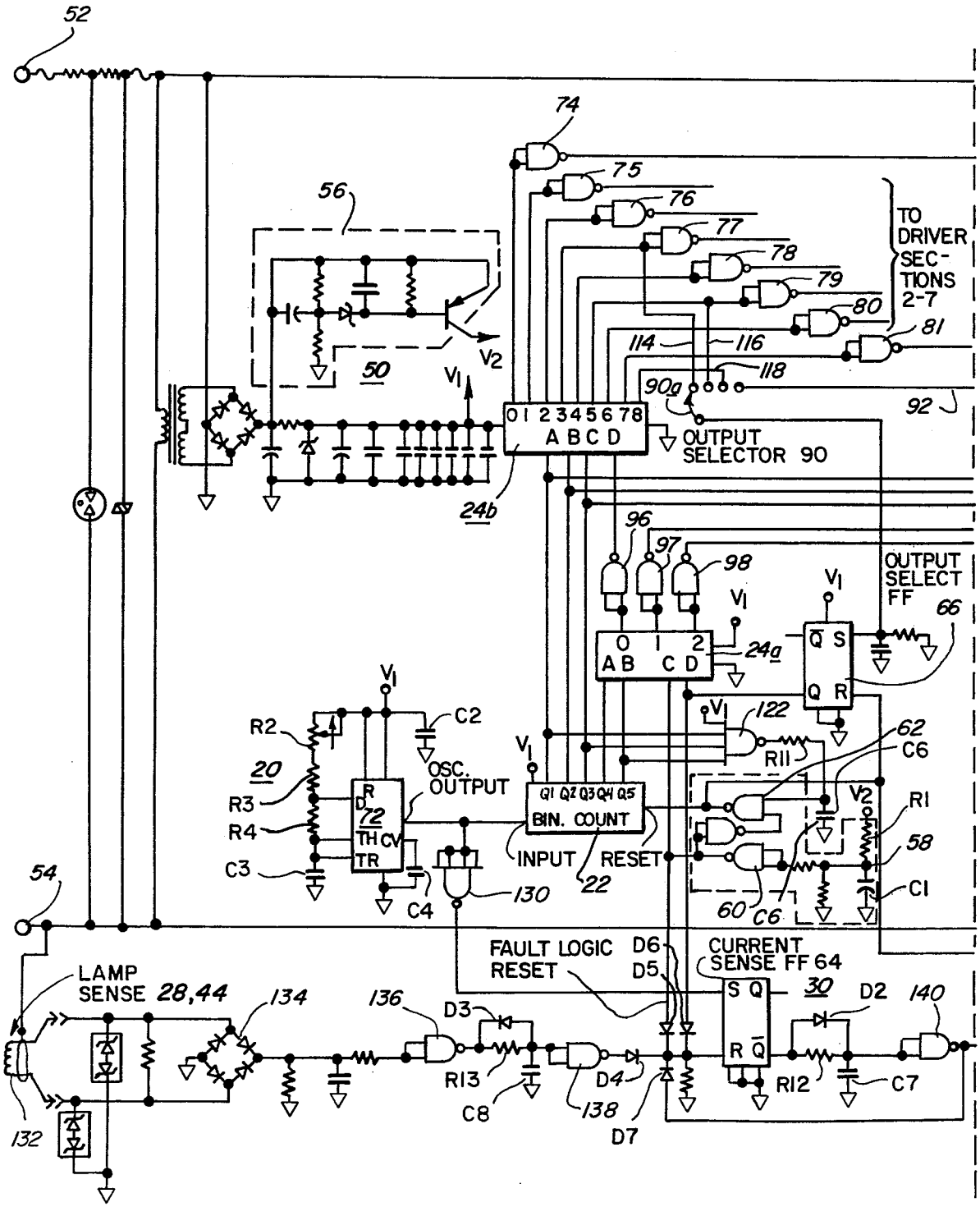
FIGS. 3A and 3B, when joined along the dashed lines, comprise a single schematic diagram of a portion of the circuitry shown in block diagram form in FIG. 2.
Figure 3B:
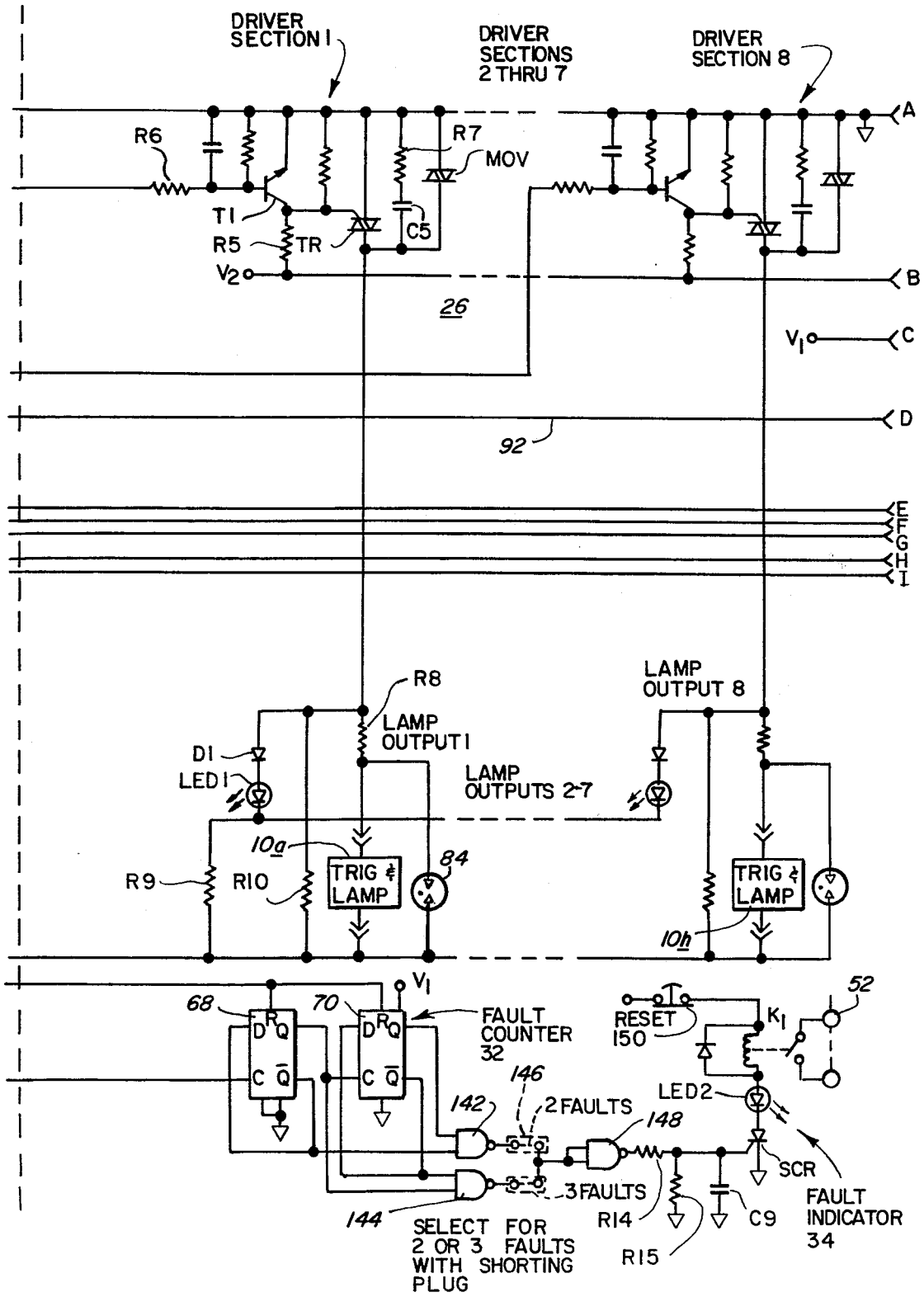

Referring now to FIGS. 3A and 3B, there is illustrated a schematic diagram of the master light lighting system and fault monitor.

DC power for the various components of the system is developed by an AC to DC converter and regulator 50 which receives AC line current across terminals 52 and 54 and converts it to regulated DC voltages, designated V1 and V2. In the preferred embodiment, V1 is equal to +12 volts and V2 is equal to +24 volts.

In practice, the voltage V2 is not developed until after a minimum time of 0.2 seconds due to the action of delay circuitry 56. Since the voltage V2 is used to energize the light drivers 26, it is desirable to provide this time delay so that the lights 10 will not be energized until the logic circuitry is energized properly to avoid a false failure indication.

A second time delay is provided by a power-on-reset circuit, or POR 58, FIG. 3A, which insures that the system is started up in a controlled manner. When power is first applied to the terminals 52,54, the voltage across a capacitor C1 in the POR 58 is zero, resulting in the output of two NAND gates 60,62 being held in a high state, i.e., having an output equal to the voltage V1 This high state signal is coupled to a reset input of the binary counter 22 which initializes the counter to zero. Moreover, the high state signal from the NAND gate 60 is coupled to a reset input of a current sensing flip-flop 64, to be described in greater detail below.

The capacitor C1 and a resistor R1 are selected to provide a minimum of 0.5 seconds delay, after which time the outputs of the NAND gates 60,62 revert to a low state, thereby enabling the counter 22 and removing the reset signal from the current sensing flip-flop 64.

In addition to resetting the binary counter 22 and the current sensing flip-flop 64, the signal from the POR circuit 58 is also used to force to a low state the outputs of two BCD/decimal decoders 24*a*,24*b*, which together comprise the BCD/decimal decoder 24 described with respect to FIG. 2. Moreover, the signal from the POR 58 resets an output select flip-flop 66, FIG. 3A, and initializes to zero the fault counter 32, FIG. 3B, which consists of two flip-flops 68,70.

During the time the POR circuit 58 is operative, i.e., immediately following and for a short time after system startup, a high state signal is coupled to the C input of the BCD/decimal decoder 24*a* from the NAND gate 60, while the remaining inputs A, B and D are held in a low state. The inputs to each of the BCD/decimal decoders, including the BCD/decimal decoder 24*a*, are in order of increasing significance from A–D, i.e., A input being the least significant and the D input being the most significant input. Since only the C input receives a high state signal, the output corresponding to the number "4" (which is not used and hence is not shown) is in a high state while the remaining outputs assume a low state. Therefore, the outputs 0, 1 and 2 of the BCD/decimal decoder 24*a* are in a low state during initialization.

Also during initialization, a high state signal is received at an input D from a NAND gate 96, connected as an inverter to the 0 output of the BCD/decimal decoder 24*a*. Consequently, the outputs 0–7 of the decimal decoder 24*b* assume a low state.

Figure 4:
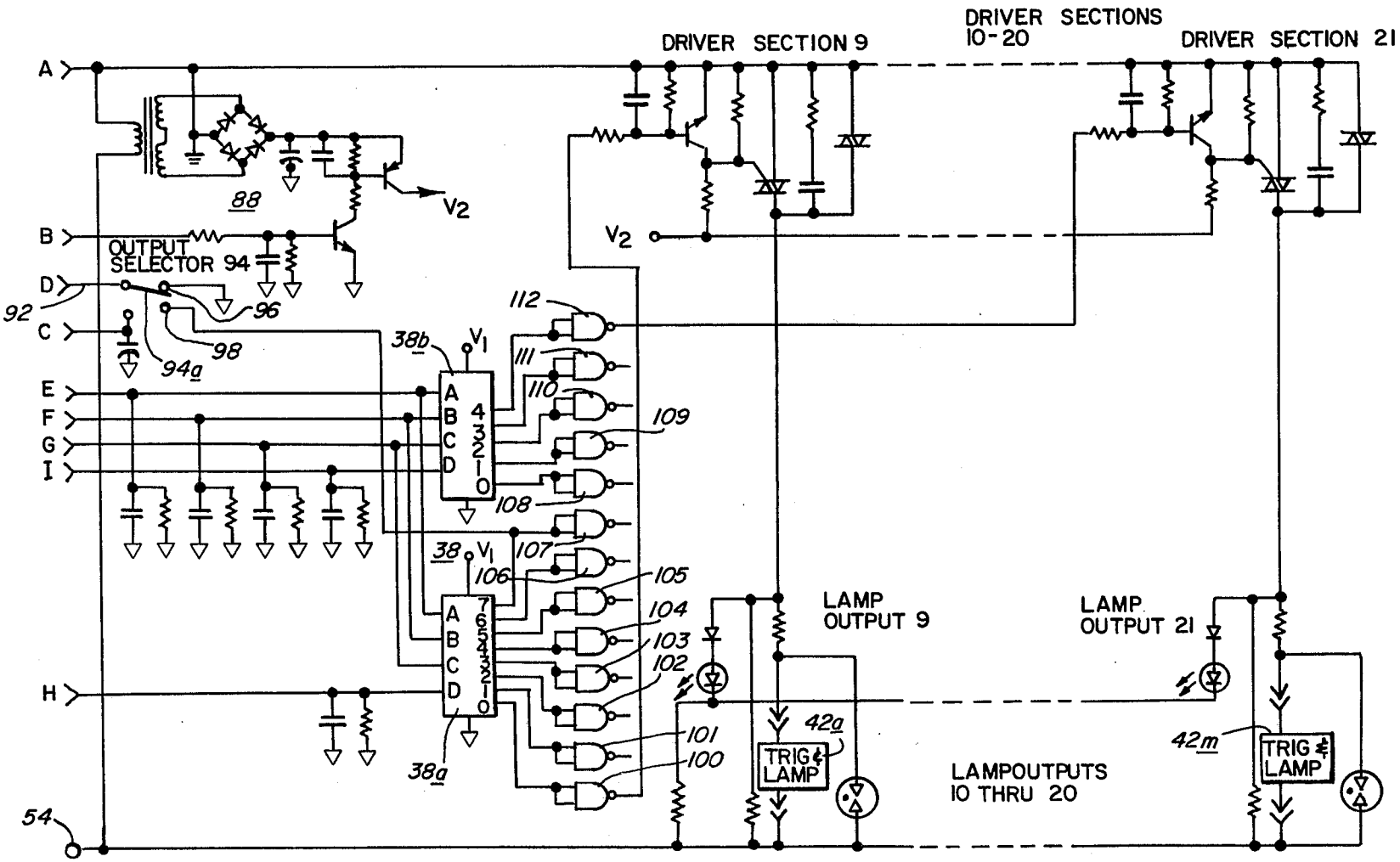
FIG. 4 is a schematic diagram of the slave light operation circuitry shown in block diagram form in FIG. 2.

If it is desired to include more than eight flashing lights in the lighting system, then the circuitry shown in FIG. 4 must be used. This circuitry is utilized by coupling the lines marked A–I with similarly lettered lines appearing in FIG. 3B and by connecting a wiper 90*a* of an output selector 90, FIG. 3A, to a line 92, for reasons to be discussed below.

During the time the POR 58 is operative, a pair of NAND gates 97,98 invert the low state signals from the outputs 1 and 2 of the BCD/decimal decoder 24*a* and couple the signals over the lines H and I to the D inputs of two BCD/decimal decoders 38*a*,38*b*, respectively, which comprise the BCD/decimal decoder 38. Consequently, each of the outputs of these BCD/decimal decoders 38 are held in a low state, with the exception of the outputs corresponding to the number "8" which are unused and hence not shown.

It should be noted that BCD/decimal decoders 24*a*, 24*b* and 38*a*,38*b* each includes 10 outputs, only several of which are used. For example, the BCD/decimal decoder 24*b* utilizes the outputs 0–7 to provide signals to a series of NAND gates 74–81 and utilizes the output 8 to set the output select flip-flop 66. Similarly, only the outputs 0–2 of the BCD/decimal decoder 24*a* are used as well as the outputs 0–7 of the BCD/decimal decoder 38*a* and the outputs 0–4 of the BCD/decimal decoder 38*b*.

LIGHT ACTUATION SYSTEM

Once the signal of the output of POR 58 reverts to a low state, the binary counter 22 indicates, via outputs Q1–Q5, the number of output pulses generated by the oscillator 20, FIG. 3A. In the preferred embodiment, the oscillator 20 is implemented by means of a 555 timer integrated circuit 72 in conjunction with peripheral components R2–R4 and C2–C4. The timer and peripheral components are connected to form an astable, asymetric multivibrator, the output period of which is established by the variable resistor R2, resistors R3 and R4 and capacitor C3. During a given period, the output of the oscillator 20 is in a high state for approximately 90% of the time.

In the embodiment shown in FIG. 3, the Q1 output of the counter 22 is the least significant bit of the number represented by the output of counter 22 and the remaining outputs are labeled in order of increasing significance with the output Q5 being the most significant bit.

The outputs Q1–Q3 of the counter 22 are connected to and decoded by the BCD/decimal decoder 24*b*. The BCD/decimal decoder 24*b* provides an output signal from outputs 0–7 to one of a series of NAND gates 74–81 depending upon the number of negative transitions developed by the oscillator 20 since resetting of the counter 22. The NAND gates 74–81 are connected as inverterdrivers which provide signals to the master light drivers 26, FIG. 3B, comprising driver sections 1–8.

Before the first negative transition of the oscillator output occurs, each of the inputs A–D of the BCD/decimal decoder 24*a* is in a low state. Therefore, the 0 output of the BCD/decimal decoder 24*a* assumes a high state, while the 1 and 2 outputs remain in the low state. At this time, each of the inputs A–D of the BCD/decimal decoder 24*b* is in a low state and consequently a signal is generated at the 0 output thereof which is coupled to the NAND gate 74. Moreover, the NAND gates 97,98, FIG. 3A, continue to couple a high state signal over the lines H and I to the BCD/decimal decoders 38*a*,38*b*, FIG. 4, and hence all of the used outputs thereof are in a low state.

The high state signal from the output 0 of the BCD/decimal decoder 24*b* in turn causes energization of the light 10*a* by a driver section 1, which is one of eight driver sections.

Since each of the driver sections 1–8 is identical, only driver section 1 will be described, it being understood that the remaining driver sections are identical thereto.

Each driver section utilizes a triac TR to generate the trigger signal by connecting the AC input source connected across the terminals 52,54 to trigger circuitry located near the runway for actuating one of the lights 10. For example, the triac TR will energize the trigger circuit and light 10*a* when a signal is provided by the NAND gate 74, in turn turning off a transistor T1 and allowing the triac TR to be gated into conduction by current passing through a resistor R5. A resistor R6 limits the amount of current from the NAND gate 74 and thereby prevents loading of the output thereof.

A resistor R7 and a capacitor C5 act as a snubber circuit to limit the rate of change of the voltage across the triac TR to prevent inadvertent firing thereof.

The trigger circuitry includes a small capacitor, for example ¼ microfarad, which discharges through a high ratio transformer to ionize the gas in one of the flash tube units 10 when the trigger signal is received by the trigger circuit. This ionization in turn causes relatively large variable capacitors, on the order of 1–30 microfarads, to discharge through the flash tube, in turn causing a light pulse to be generated.

Since the lights and trigger circuitry are located on the runway approach area remote from the balance of the operating circuitry of the runway approach lighting system, the trigger signals must be coupled to this circuitry via long cables which may pick up stray signals of high amplitude. To provide transient protection against these strong signals, and to limit transient conditions occurring at the AC line input across terminals 52 and 54, the triac TR is protected by a fast-acting metal oxide varistor MOV which limits the maximum voltage across TR. Further transient protection is provided by a spark gap 84, connected within a light output circuit, which is slower acting than the varistor MOV, but which acts to dissipate the bulk of the transient energy induced in the cables.

Each of the trigger circuitry and lights 10 is connected within a light output circuit, designated light outputs 1–8. The light output circuit 1 will be described with the understanding that the light output circuits 2–8 are identical thereto. The spark gap 84 is connected across the light 10*a* to dissipate transient energy as noted above. A resistor R8 limits the current through the triac TR and through the varistor MOV. The light output circuit 1 also includes a diode D1 and a light emitting diode, or LED 1, connected in series from the triac TR through a current limiting resistor R9 to the AC line input 54. It should be noted that the resistor R9 is common to each of the light output circuits 1–8.

A resistor R10 shunts residual current due to the snubber circuit comprised of the resistor R7 and the capacitor C5 away from the circuit consisting of the diode D1 and the LED 1.

If the approach lighting system is similar to that shown in FIG. 1, i.e., if only five lights 10*a*–10*e* are utilized, then the driver sections 6, 7 and 8 and the light outputs 6, 7 and 8 would not be utilized.

Upon receipt of the first negative transition from the oscillator 20, the binary counter advances by one, thereby generating a high state signal on the Q1 output thereof. The signal is coupled to the A input of the BCD/decimal decoder 24*b*, in turn causing the output 0 thereof to revert to a low state and the output 1 thereof to assume a high state. The signal on the output 1 of the BCD/decimal decoder 24*b* is inverted by the NAND gate 75, in turn gating into conduction the triac TR of the driver section 2, thereby energizing the light 10*b*.

The removal of the signal at the output 0 of the BCD/decimal decoder 24*b* turns off the triac TR of driver section 1, deenergizing the light 10*a*. Consequently, only the light 10*b* is energized at this time.

Upon receipt of succeeding negative transitions from the oscillator output 20, the binary counter will continue to increment by one, in turn sequentially energizing the driver sections 3–8 and the lights 10*c*–10*h* by means of the NAND gates 76–81 (assuming all eight lights 10 are used). Moreover, during this time the slave lights 42, FIG. 4, continue to be held in a deenergized state due to the high state signals coupled on the lines H and I.

The description of the slave light circuitry shown in FIG. 4 will be made under the assumption that it is desired to utilize a total of 21 flashing lights in the lighting system, i.e., the lights 10*a*–10*h* plus 11 slave lights 42*a*–42*m*. It should be noted, however, that a total of 15 lights may be used instead and the selection of either 21 or 15 lights may be made by connecting a wiper 94*a* of an output selector 94, FIG. 4, to either a line 96 or a line 98, respectively, as described more fully hereinafter.

Upon receipt of the next negative transition from the oscillator 20 following actuation of the light 10*h*, the outputs Q1–Q3 revert to a low state while the output Q4 assumes a high state. The high state signal from the output Q4 is coupled to the A input of the BCD/decimal decoder 24*a*, in turn causing the output 1 of the BCD/decimal decoder 24*a* to assume a high state while the outputs 0 and 2 are in a low state. At this time, the D input of the BCD/decimal decoder 24*b* receives a high signal, in turn causing the output 8 to assume a high state while the remaining outputs are in a low state. Therefore, during this time, each of the lights 10*a*–10*h* is deenergized.

The high state signal present at the output 1 of the BCD/decimal decoder 24*a* is inverted by the NAND gate 97 and this low state signal is coupled over the line H to the D input of the BCD/decimal decoder 38*a*. Moreover, at this time the low state signal appearing at the output 2 of the BCD/decimal decoder 24*a*, FIG. 3A, is inverted by the NAND gate 98 and is coupled over the line I to the D input of the BCD/decimal decoder 38*b*, FIG. 4. Consequently, the BCD/decimal decoder 38*b* is prevented from decoding the outputs Q1–Q3 coupled to the lines E, F and G.

The BCD/decimal decoder 38*a*, which is now enabled by the removal of the high state signal on the line H, decodes the information at the outputs Q1, Q2 and Q3, respectively, of the binary counter 22. Since at this time the outputs Q1, Q2 and Q3 are all in a low state, the output 0 of the BCD/decimal decoder 38*a* is energized, in turn signaling the driver section 9 through a NAND gate 100 to energize the light 42*a*.

It should be noted that the driver sections and light outputs 9–21 shown in FIG. 4 are each identical to the driver section and light output 1 shown in FIG. 3B and described above.

As the binary counter 22 continues to increment in response to negative transitions from the oscillator 20, the outputs 1–7 of the BCD/decimal decoder 38*a* will be sequentially energized, similar to the outputs of the BCD/decimal decoder 24*b*. The signals from the outputs 1–7 of the BCD/decimal decoder 38*a* are inverted by the NAND gates 101–107, respectively, and are coupled to the driver sections 10–16, respectively. The lights 42*a*–42*h* are therefore sequentially energized in a fashion similar to the lights 10*a*–10*h*.

At the time the output 7 of the BCD/decimal decoder 38*a* assumes a high state, each of the outputs Q1, Q2, Q3 and Q4 of the binary counter 22, FIG. 3A, is in a high state, while the output Q5 is in a low state. Upon receipt of the next negative transition from the oscillator 20, the output Q5 switches to a high state while the outputs Q1–Q4 assume a low state. This sequence of signals in turn causes the output 2 of the BCD/decimal decoder 24*a* to assume a high state while the 0 and 1 outputs are in a low state. As previously noted, the BCD/decimal decoder 24*b* outputs are inhibited by the high state signal coupled to the D input thereof from the NAND gate 96. Also, the BCD/decimal decoder 38*a* outputs 0–7 all assume a low state due to the high state signal from the NAND gate 97 coupled over the line H to the D input thereof.

The high state signal appearing at the output 2 of the BCD/decimal decoder 24*a* is inverted by the NAND gate 98, and this low state signal is coupled over the line I to the D input of the BCD/decimal decoder 38*b*. The BCD/decimal decoder 38*b* is therefore enabled and allowed to decode the signals from the binary counter 22 outputs Q1–Q3. At this time, each of these outputs Q1–Q3 is in a low state. Therefore, the output 0 of the BCD/decimal decoder 38*b* assumes a high state and hence the driver section 17 is instructed, via a NAND gate 108, to energize the light 42*i*.

Upon receipt of succeeding pulses from the oscillator 20, the binary counter increments by one and hence the outputs 1–4 of the BCD/decimal decoder 38*b* are successively energized. The high state signals from the outputs 1–4 are coupled through NAND gates 109–112 to the driver sections 18–21, in turn sequentially energizing the slave lights 42*j*–42*m*.

The energization cycle of the lights 10 and 42 is reinitiated by means of the output selectors 90 and 94. The wiper 90*a* of the selector 90 is movable between four lines 114, 116, 118 and 92 to select operation of three, five, eight and 15 or 21 lights. For example, if only three lights are used in the runway lighting system, then the wiper 90*a* is coupled to the line 114, as shown in FIG. 3A, which is in turn coupled to the input of the NAND gate 77. When an output pulse is generated at the output 3 of the BCD/decimal decoder 24*b*, then a signal is coupled over the line 114 to the "set" input of the output select flip-flop 66. A high state signal is immediately generated by the Q output of the flip-flop 66 which is coupled to the D input of the BCD/decimal decoder 24*a*. This signal in turn causes the outputs 0, 1 and 2 of BCD/decimal decoder 24*a* to immediately assume a low state, in turn forcing all of the outputs 0–7 of the BCD/decimal decoder 24*b* to assume a low state. This prevents any of the used outputs 0–7 of the BCD/decimal decoder 24*b* from being activated until the energization cycle sequence is reset as described below.

If five or eight lights 10 are utilized in the runway lighting system, then the wiper 90*a* is moved to the lines 116 or 118, respectively. In either instance, the operation is exactly the same as described with respect to the line 114. The result is that only those outputs which correspond to the number of lights N used in the runway lighting system are allowed to be actuated, with the remaining outputs being inhibited when the (N+1)th output of the BCD/decimal decoder 24*b* is energized due to the action of the output select flip-flop 66.

If 15 lights are utilized, then the wiper 90*a* is connected to the line 92 and the wiper 94*a*, FIG. 4, is connected to the line 98. Again, the effect is to inhibit actuation of the light driver sections 16–21.

If 21 lights are used, then the wiper 94a is coupled to the line 96, which is in turn coupled to ground. In this case, no signal will be returned to the "set" input of flip-flop 66, and hence all the driver sections 1–21 will be used.

The energization cycle sequence is reinitiated by means of a NAND gate 122 which senses the Q1, Q3 and Q5 outputs of the binary counter 22. The binary counter 22 will continue advancing in response to negative transitions from the oscillator 20 until the output number 22 is sensed by the NAND gate 122. When this occurs, the output of the NAND gate 122 assumes a low state, and, after a slight delay produced by a resistor R11 and capacitor C6, the output of the NAND gate 62 is forced to assume a high state. This high state signal is coupled to reset input of the counter 22, in turn reinitializing the counter 22. The reset signal is only a momentary signal, since the output of the NAND gate 122 will assume a high state once the counter 22 has been reinitialized.

FAULT MONITOR SYSTEM

As previously noted, the fault monitor system consists primarily of the sensing circuit 28, the comparator 30, the fault counter 32, and the fault indicator 34.

The comparator 30 consists of the current sensing flip-flop 64 in conjunction with a diode D2, a resistor R12 and a capacitor C7.

The "set" input of the current sensing flip-flop 64 is coupled to the oscillator 20 output through an inverter consisting of a NAND gate 130. The flip-flop 64 is "set", i.e., a low state signal is provided on the $\overline{Q}$ output thereof, for each negative transition of the oscillator 20.

The "reset" input of the flip-flop 64 receives pulses from the light sensing circuit 28. The discharge current of the relatively large variable capacitors through each of the flash tube units 10 and 42 is sensed by a current transducer, such as the coil 132 shown in FIG. 3A. In practice, there is a current transducer for sensing the discharge current through each of the lights 10a–10h and 42a–42m and the transducers are connected in parallel with one another across a rectifier circuit 134.

Alternatively, the current transducer may be replaced by a different type of sensor, such as a photoelectric cell or other type of device which is adapted to sense the actual light output from the lights as opposed to sensing the discharge current through the flash tube unit.

The rectifier circuit converts the signal from the coil 132 into a unipolar output. This signal is inverted by a NAND gate 136 and the duration of the signal is extended by a capacitor C8, a resistor R13 and diode D3 such that the duration is at least 15% of the total period of the oscillator signal. This signal is again inverted by a NAND gate 138 and is coupled through a diode D4 to the "reset" input of the flip-flop 64.

Also, coupled to the "reset" input of the flip-flop 64 through diodes D5 and D6, respectively, is the output from the NAND gate 60 and the Q output from the output select flip-flop 66. A fourth signal is applied to the "reset" input from the output of a NAND gate 140 described below.

At the time power is first applied to the circuitry, the NAND gate 60 applies a high state signal to the "reset" input of flip-flop 64, thereby causing a high state output to appear at the $\overline{Q}$ output thereof. This high state signal rapidly charges the capacitor C7 through the diode D2 and causes the output of the NAND gate 140 to assume a low state.

Once the signal from the POR circuit 58 is terminated, the first negative transition from the oscillator 20 sets the current sensing flip-flop 64, in turn causing the $\overline{Q}$ output thereof to assume a low state. The capacitor C7 then slowly discharges through the resistor R12 to ground.

As previously noted, once the NAND gate 60 output assumes a low state, the lamp 10a is energized, if operative, resulting in a pulse being generated in the coil 132 which is subsequently applied to the "reset" input of the flip-flop 64.

If, however, the light 10a fails to operate and generate a pulse which is applied to the "reset" input of flip-flop 64 within approximately 60% of the total oscillator period, then the capacitor C7 will discharge to a point low enough to cause a high state signal or fault pulse to be coupled to a clock input of the flip-flop 68 from the NAND gate 140. At this time, this same pulse is coupled back to the "reset" input of the flip-flop 64 through a diode D7. The flip-flop 64 will continue to be in the reset state until the next negative transition from the oscillator 20 is received at the "set" input thereof.

As the binary counter 22 advances by one for each negative output of the oscillator 20, signals will be generated to the fault counter 32 for each malfunctioning light. The output of the fault counter 32 advances by one for each fault pulse received. It should be noted that the flip-flops 68 and 70 are connected in a modulo-four counter configuration.

The $\overline{Q}$ outputs of the flip-flops 68,70 are coupled to NAND gates 142,144 which generate output pulses if two or three faults occur during an energization cycle, respectively. If it is desired to provide an indication that two faults have occurred in an energization cycle, then a shorting plug 146 is utilized to couple the output of the NAND gate 142 with an input of a NAND gate 148, connected as an inverter. Conversely, if it is desired to indicate that three faults have occurred in an energization cycle, then the shorting plug 146 is utilized to connect the output of the NAND gate 144 to the input of the NAND gate 148.

If the specified number of faults should occur in an energization cycle, then a signal is generated by the NAND gate 148, which is filtered by resistors R14 and R15 and capacitor C9. This signal is used to latch a silicon controlled rectifier SCR into the conductive state. This in turn causes a relay coil K1 and a light emitting diode LED 2 to be energized, hence closing the normally open contacts of the relay K1.

A resetting of the relay K1 can only be accomplished by actuating a reset switch 150 which interrupts the current to the relay coil K1.

The relay contacts of relay K1 may be used to operate audible and/or visual alarms.

It should be noted that during the time that the POR 58 is operating, a reset signal is provided from the output of the NAND gate 62 to the flip-flops 68,70 to reinitialize the outputs thereof to zero. Furthermore, at the end of each energization cycle, these flip-flops 68,70 are reset due to the action of NAND gates 122 and 62.

We claim:

1. A system for individually energizing each of a plurality of output devices including means for providing a fault indication when a preselected number of the output devices are inoperative, comprising:

means coupled to the output devices for generating trigger signals to individually energize each output device;

means coupled to the output devices for sensing the output of each output device to develop monitoring signals;

means for comparing the trigger signals with the monitoring signals to develop status signals representing the operative status of each output device; and means for generating a fault indication in response to the status signals when at least the preselected number of output devices are inoperative.

2. The system of claim 1, wherein the trigger signal generating means includes:

an oscillator for producing clock pulses;

a pulse counter coupled to the oscillator having an output representing the number of clock pulses received from the oscillator; and means for decoding the pulse counter output to sequentially energize the output devices.

3. The system of claim 2, wherein the decoding means comprises a BCD/decimal decoder having an output and wherein the system further includes means for actuating the output devices in response to the output of the BCD/decimal decoder.

4. The system of claim 3, further including means for sequentially energizing a selected number of output devices, including means for generating an inhibit signal to inhibit the BCD/decimal decoder output when the selected number of output devices have been sequentially energized.

5. A fault detection system for generating a fault indication when a preselected number of a plurality of individually energized output devices fail to actuate in response to trigger signals, comprising:

means coupled to the output devices for sensing the output of each output device to develop monitoring signals;

means for comparing the trigger signals with the monitoring signals to develop status signals representing the operative status of each output device; and means for generating a fault indication in response to the status signals when at least the preselected number of output devices are inoperative.

6. The system of claim 5, wherein the comparing means includes:

a first input coupled to the signal generating means;

a second input coupled to the monitoring signal developing means; and means for developing a fault pulse when an output from the output device fails to occur within a time period following the generation of an trigger signal.

7. The system of claim 6, wherein the fault indication generating means includes a fault counter coupled to the fault pulse developing means for counting the number of fault pulses.

8. The system of claim 7, wherein the fault indication generating means further includes means coupled to the fault counter for generating the fault indication when the preselected number of fault pulses are generated during a second time period.

9. The system of claim 7, wherein the fault indication generating means includes:

means for decoding the output of the fault counter to generate a latching signal when the preselected number of fault pulses are generated during a second time period;

a visual fault indicator; and a latching circuit for maintaining the visual fault indicator in an energized state when the latching signal is generated.

10. The system of claim 7, further including means coupled to the output of the pulse counter for resetting the fault counter to zero at the end of a second time period.

11. The system of claim 5, wherein the means for sensing includes:

means for generating a feedback pulse in response to the output of each output device;

means for converting each sensing pulse into a unipolar signal; and means coupled to the converting means for extending the time duration of each unipolar signal.

12. A runway lighting system for sequentially energizing a plurality of lights, comprising:

an oscillator for developing clock pulses;

a pulse counter coupled to the oscillator having a digital output representing the number of clock pulses received from the oscillator;

means having a plurality of outputs for converting the digital output of the pulse counter to cause signal pulses to sequentially appear at the plurality of outputs; and a plurality of light drivers coupled to the plurality of outputs of the converting means and responsive to the signal pulses for sequentially energizing the lights.

13. The runway lighting system of claim 12, wherein the converting means includes a BCD/decimal decoder for converting the digital output of the pulse counter into decimal form.

14. The runway lighting system of claim 13, wherein the BCD/decimal decoder includes a first number of outputs which sequentially generate a first number of signal pulses, and wherein the converting means further includes:

a second BCD/decimal decoder coupled to the pulse counter output having a second number of outputs which sequentially generate signal pulses; and means for inhibiting the second BCD/decimal decoder to prevent the generation of signal pulses thereby until the first number of signal pulses are generated.

15. The runway lighting system of claim 14, wherein the inhibiting means includes a third BCD/decimal decoder coupled to the pulse counter output for generating an inhibit signal to inhibit the second BCD/decimal decoder while the first number of signal pulses are generated.

16. The runway lighting system of claim 12, further including means for resetting the pulse counter output to zero when a number of clock pulses have been received by the pulse counter.

17. The runway lighting system of claim 12, further including means for selecting operation of a number of lights less than the plurality, the selecting including means for inhibiting the outputs of the converting means when a signal pulse appears at an $(N+1)$th output of the converting means, where N equals the number of lights.

18. An energization system for sequentially energizing lights used in a runway lighting system, comprising:

a first energization unit including means for generating clock pulses;

means coupled to the generating means having an output for accumulating the number of clock pulses generated thereby;

first means coupled to the accumulating means having a first number of outputs for decoding the output of the accumulating means to sequentially energize a first set of lights; and a second energization unit including second means having a second number of outputs for decoding the output of the accumulating means to sequentially energize a second set of lights following the sequential energization of the first set of lights.

19. The energization system of claim 18, wherein the first decoding means includes means for inhibiting the outputs of the second decoding means until all of the first set of lights have been sequentially energized.

20. The energization system of claim 18, wherein the first energization unit further includes means for sequentially energizing a selected number of lights less than the number of lights in the first set including means for inhibiting the outputs of the first decoding means immediately following sequential energization of the selected number of lights.

21. The energization system of claim 18, wherein the second energization unit further includes means for sequentially energizing a selected number of lights less than the number of lights in the second set of lights, including means for inhibiting the outputs of the second decoding means immediately following sequential energization of the selected number of lights.

* * * * *